United States Patent [19]

Deverell

[11] 4,043,838

[45] Aug. 23, 1977

[54] METHOD OF PRODUCING PITTING RESISTANT, HOT-WORKABLE AUSTENITIC STAINLESS STEEL

[75] Inventor: Harry E. Deverell, Natrona Heights, Pa.

[73] Assignee: Allegheny Ludlum Industries, Inc., Pittsburgh, Pa.

[21] Appl. No.: 730,400

[22] Filed: Oct. 7, 1976

Related U.S. Application Data

[62] Division of Ser. No. 571,460, April 25, 1975, Pat. No. 4,007,038.

[51] Int. Cl.[2] ..... C21D 7/13

[52] U.S. Cl. ..... 148/2; 148/12 E; 148/38

[58] Field of Search ..... 148/2, 3, 12 E, 38; 75/122, 128 E, 128 W, 134 F

[56] References Cited

U.S. PATENT DOCUMENTS

| | | | |
|---|---|---|---|
| 2,553,330 | 5/1951 | Post et al. | 75/128 E |
| 3,547,625 | 12/1970 | Bieber et al. | 75/128 W |
| 3,729,308 | 4/1973 | Eiselstein | 75/128 E |
| Re. 24,243 | 12/1956 | Lohr | 75/128 E |

*Primary Examiner*—Arthur J. Steiner
*Attorney, Agent, or Firm*—Vincent G. Gioia; Robert F. Dropkin

[57] ABSTRACT

An austenitic stainless steel alloy which has extremely good pitting resistance and at the same time has good hot-workability characteristics. The alloy contains, as essential constituents, chromium, nickel, molybdenum, calcium and cerium. In achieving the desirable characteristics of the invention, the molybdenum and chromium levels are important in determining pitting resistance; while recoveries of cerium and calcium in the final alloy are important in determining the hot-workability of the alloy, although cerium is the more important of the two. Sulfur levels are preferably maintained low, on the order of 0.006% or less.

Also disclosed is a method for making an alloy of the type described above wherein the finishing temperature of hot-rolled strip is maintained around or above 1800° F to reduce edge cracking and preferably is maintained at about 2000° F.

4 Claims, 8 Drawing Figures

FIG. 3. EDGE CHECKING (HOT FINISH STRIP) VERSUS CERIUM RECOVERY
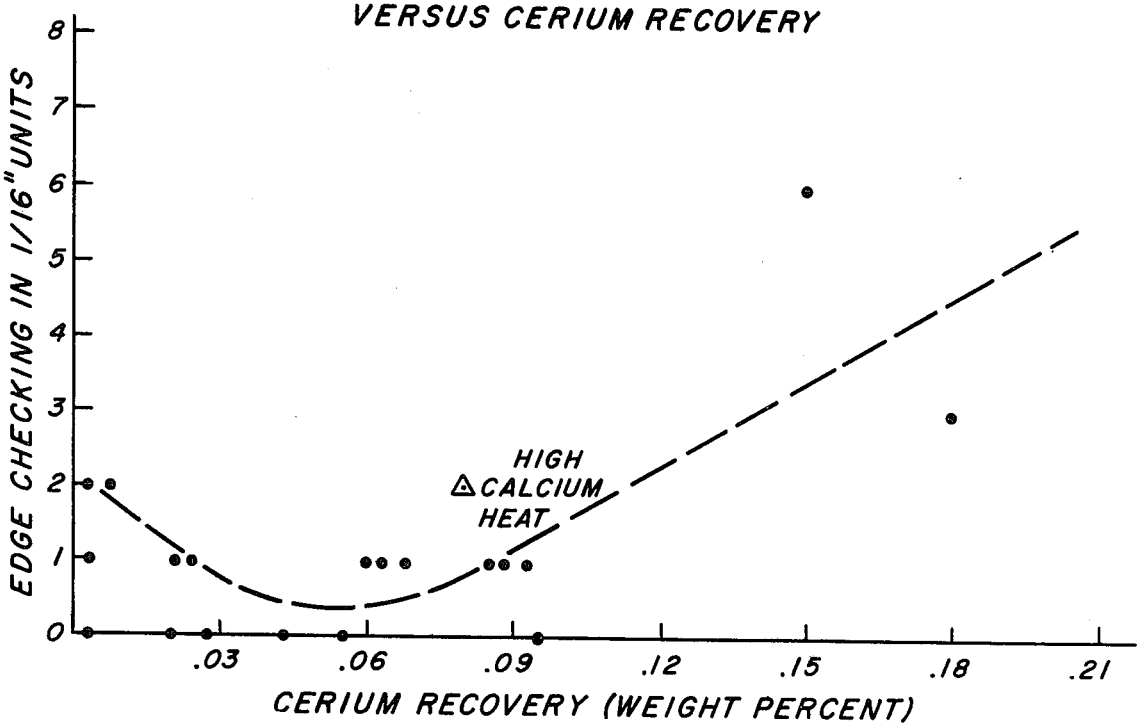
FIG. 4. EDGE CHECKING (HOT FINISH STRIP) VERSUS CERIUM PLUS CALCIUM RECOVERY
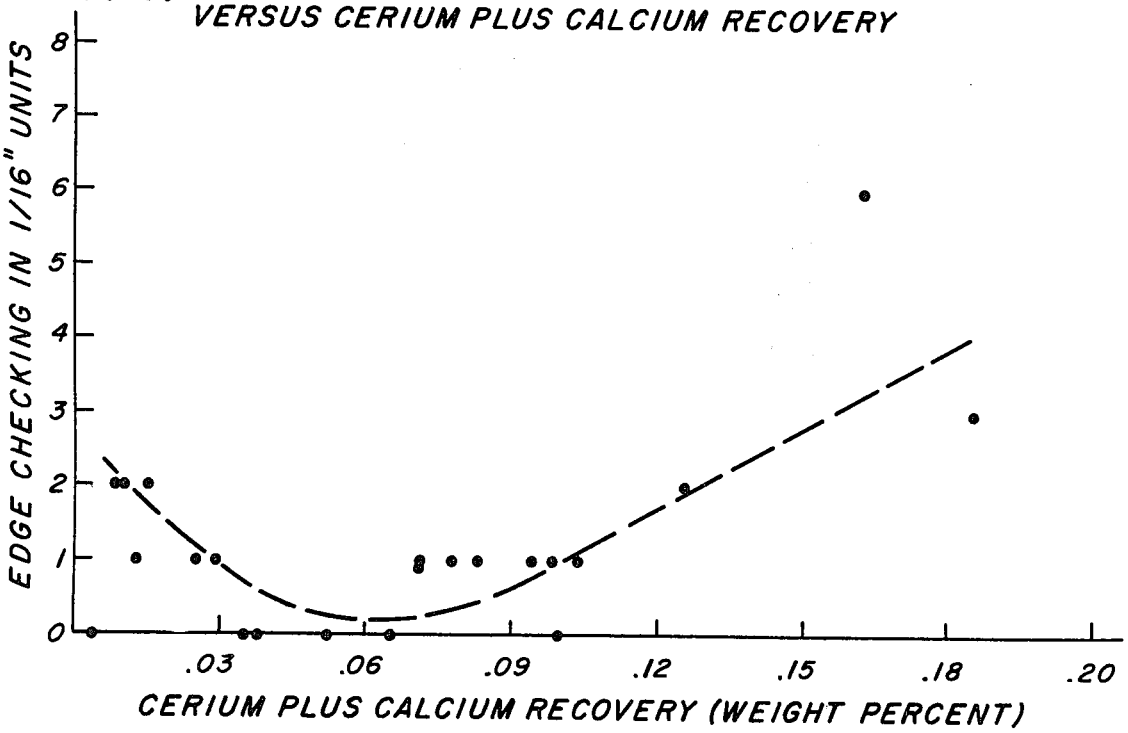

FIG. 5. EDGE CHECKING (COLD FINISH STRIP) VERSUS CERIUM RECOVERY
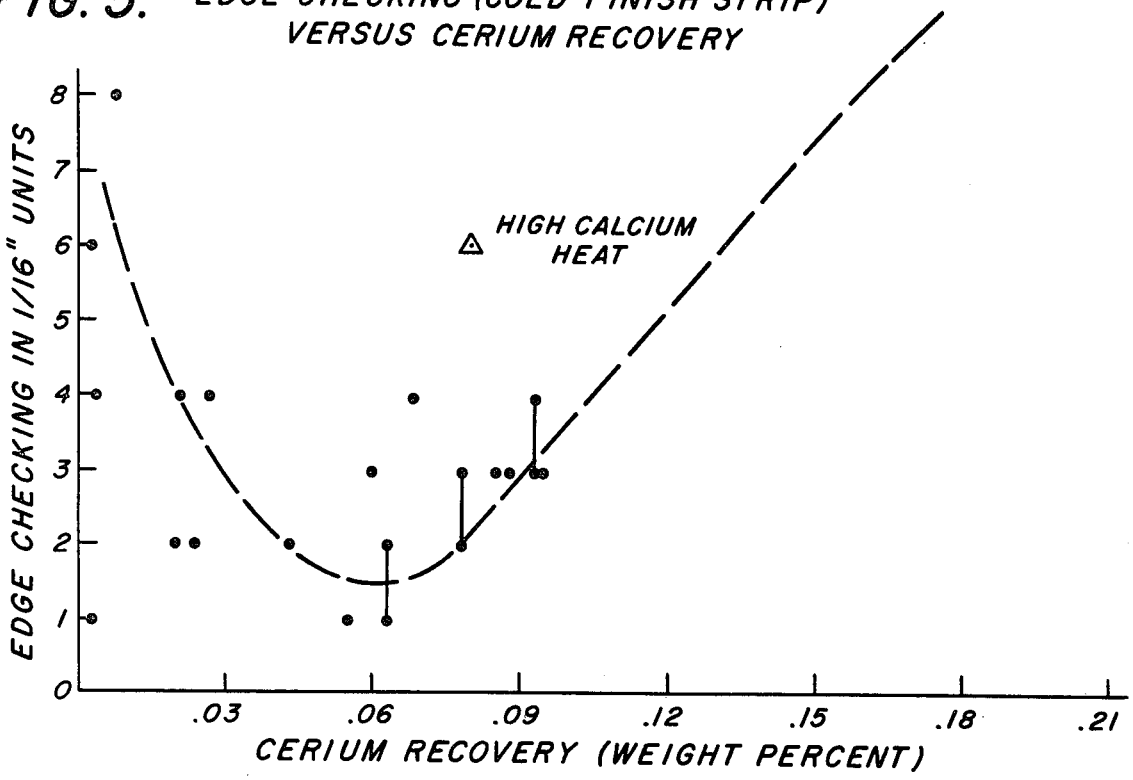
FIG. 6. EDGE CHECKING (COLD FINISH STRIP) VERSUS CERIUM + CALCIUM RECOVERY
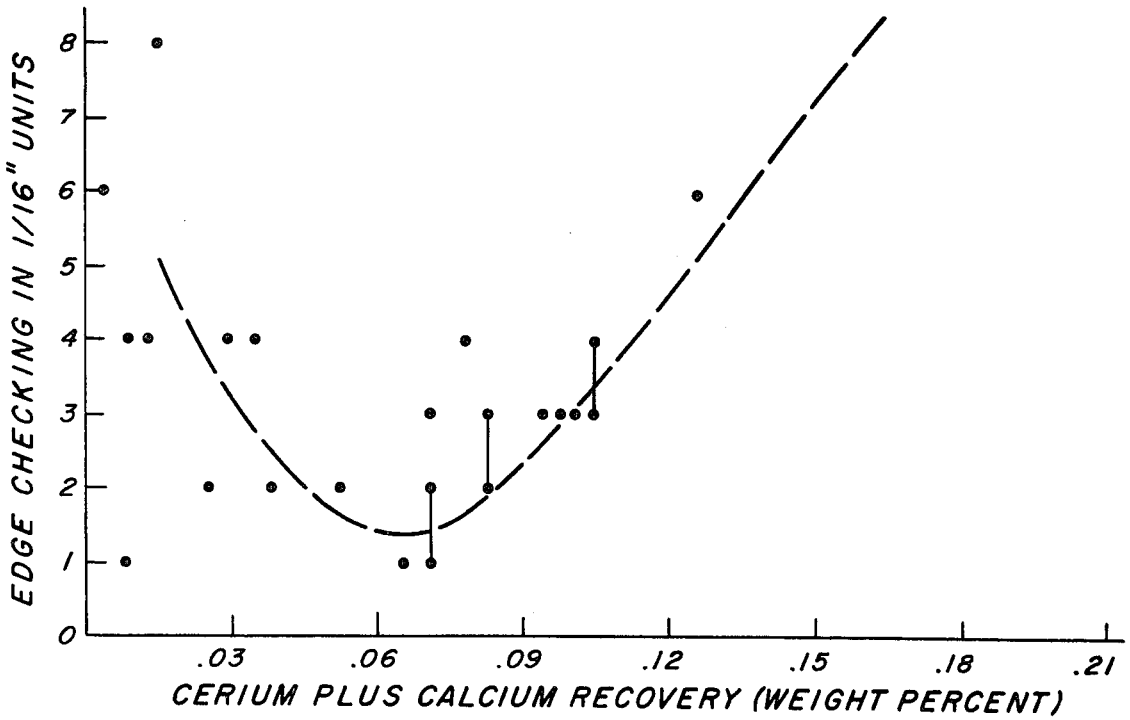

FIG. 7. 1800° F. FINISH EDGE CHECKING VERSUS SULFUR FOR HEATS WITH .10% MAXIMUM CERIUM + CALCIUM RECOVERY
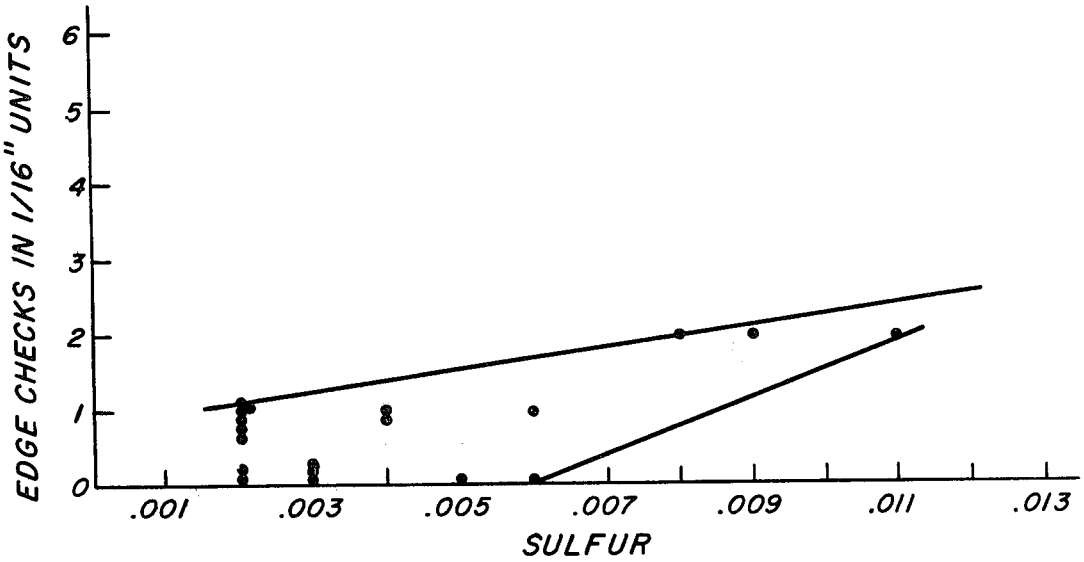
FIG. 8. 1500° F. FINISH EDGE CHECKING VERSUS SULFUR FOR HEATS WITH .10% MAXIMUM CERIUM + CALCIUM RECOVERY
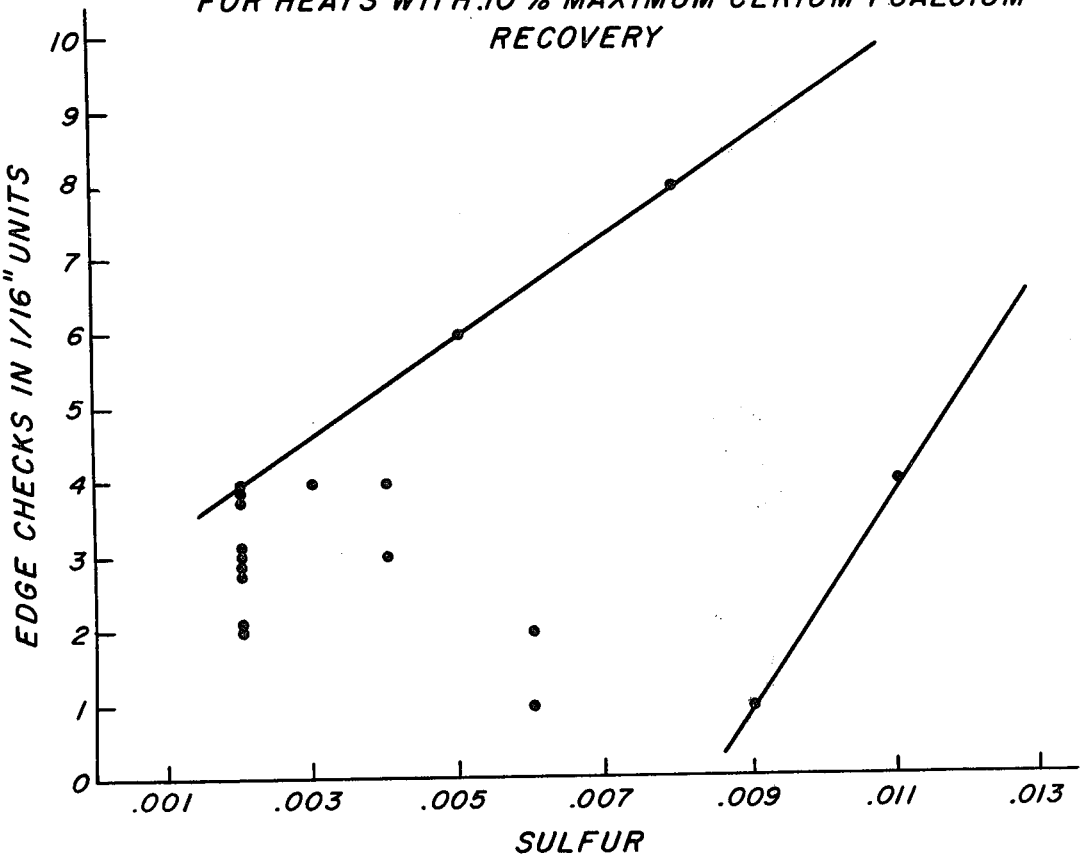

METHOD OF PRODUCING PITTING RESISTANT, HOT-WORKABLE AUSTENITIC STAINLESS STEEL

This is a division of application Ser. No. 571,460, filed Apr. 25, 1975, now U.S. Pat. No. 4,007,038.

BACKGROUND OF THE INVENTION

As is known, the chloride ion in contact with metal produces a very unique form of corrosion called pitting. This form of attack affects most materials contemplated for use in certain environments such as sea water and certain chemical process industry media. While most forms of corrosion proceed at a predictable and uniform rate, pitting is characterized by its unpredictability. In most corrosive atmospheres, metal is uniformly dissolved with relatively uniform loss of gage from attack on all parts of the surface area of a sample. However, pitting is characterized in that it concentrates in specific and unpredictable parts of the metal surface, with attack concentrated in some few places by leaving the surrounding metal virtually untouched. Once initiated, the pitting process stimulates itself (i.e., the process is autocatalytic) concentrating the chloride ion into the initiated pit and accelerating the reaction rate.

In the past, austenitic stainless steels have been developed which are resistant to pitting by virtue of a relatively high level of chromium and especially a high level of molybdenum. One such alloy, for example, is described in Bieber et al. U.S. Pat. No. 3,547,625, issued Dec. 15, 1970. Other examples of austenitic stainless steels containing high levels of molybdenum and chromium are U.S. Pat. Nos. 3,726,668; 3,716,353 and 3,129,120. Unfortunately, producers have had difficulty in producing austenitic stainless steels with a high molybdenum content due to their poor hot-workability. For example, Type 334 stainless steel containing essentially no molybdenum is relatively easy to hot-work; Type 316 stainless steel containing 2% to 3% molybdenum has decreasing hot-workability characteristics; and Type 317 stainless steel containing 3% to 4% molybdenum is extremely difficult to hot-work with the result that certain steel concerns decline to produce it.

In the past, various alloying additions have been tried in an effort to improve hot-workability. Additions of up to 0.23% aluminum have been found to actually decrease hot-workability. Magnesium in the range of less than 0.001% to 0.06% tends to improve the hot-workability of austenitic stainless steels; however, magnesium is difficult to add to a melt with any degree of control of recovery and the workability is not materially improved.

SUMMARY OF THE INVENTION

In accordance with the present invention, a new and improved high-molybdenum austenitic stainless steel with good pitting resistance is provided which, by virtue of the addition of critical amounts of both calcium and cerium, has good hot-workability characteristics.

Specifically, the invention resides in the realization that a significant improvement in hot-workability can be achieved by the use of critical additions of both calcium and cerium to an austenitic stainless steel contaiing about 20% to 40% nickel, about 6% to 12% molybdenum and about 14% to 21% chromium.

Broadly speaking, calcium can be present in the range of about 0.005% to 0.05%; while cerium should be present in the range of about 0.010% to 0.20% to achieve the desirable results of the invention.

In the preferred embodiment of the invention, calcium should be present in the range of 0.005% to 0.015%; cerium should be present in the range of 0.020% to 0.080% and the amount of cerium plus calcium should be in the range of 0.03% to 0.10%. Ideally, 0.07% maximum cerium plus calcium is needed for optimum hot-workability. The allow can additionally contain up to 0.2% carbon and up to 2% manganese with incidental amounts of silicon and aluminum. Sulfur should be maintained low, on the order of 0.006% or less, ideally 0.002% or less. Columbium may be added to 1.00% maximum and vanadium to 0.5% maximum to stabilize the alloy against chromium carbide precipitation.

Further, in accordance with the invention it has been found that edge cracking can be reduced in an alloy of the type described above if the hot finishing temperature is maintained around or above 1800° F and preferably at about 2000° F. Below 1800° F, some minor amount of edge cracking is likely to occur, even with the critical additions of cerium and calcium.

The above and other objects and features of the invention will become apparent from the following detailed description taken in connection with the accompanying drawings which form a part of this specification, and in which:

FIG. 3 is a plot of edge cracking versus cerium content in the alloy of the invention as hot finish strip;

FIG. 4 is a plot of edge cracking versus cerium plus calcium content in the alloy of the invention as hot finish strip;

Figure 1:
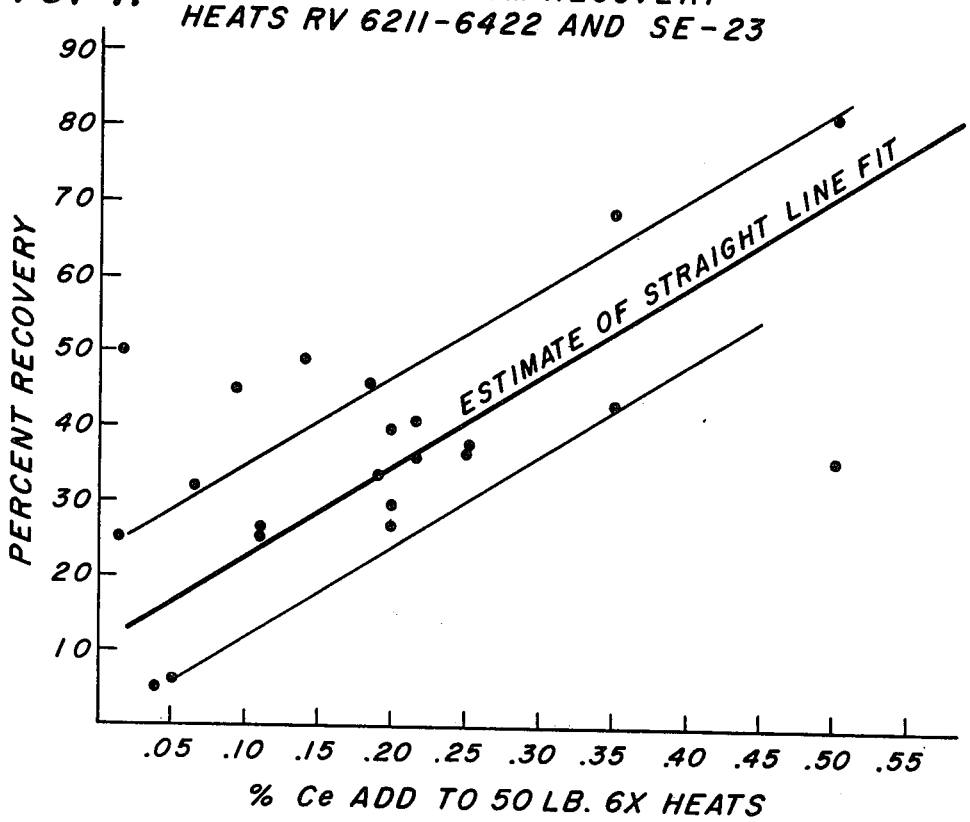
FIG. 1 is a plot of cerium recovery in the alloy of the invention versus cerium additions to the melt.

FIGS. 5 and 6 are plots similar to FIGS. 3 and 4, respectively, except for cold finish strip; and FIGS. 7 and 8 are plots showing the effect of sulfur additions on edge cracking in the allow of the invention.

DESCRIPTION OF THE PREFERRED EMBODIMENT

In order to illustrate the beneficial results of the invention, 50 pound vacuum-induction melt laboratory heats were melted with varying calcium and Mischmetal (50% cerium) additions. These heats were then processed to plate and strip with controlled finish temperatures observed. The degree of edge cracking resulting as a function of finish temperature and additions was then measured. Since the close control of finish temperature on a laboratory hot mill is difficult, the observed edge cracking tendency was confirmed by Gleeble tests on as-hot rolled specimens taken to lie in the longitudinal direction and tested on cooling from 2250° to 1800° F where a pronounced minimum area reduction has been demonstrated and also on cooling to 1600° F to demonstrate the effect of Mischmetal and calcium on area reduction at the lower end of the hot-working range.

The composition of heats melted is shown in the following Table I:

TABLE I

Composition of Laboratory Heats*

| Heat RV- | S | Cr | Ni | Mo | Ca | Ce |
|---|---|---|---|---|---|---|
| 6211 | .002 | 20.28 | 24.45 | 6.48 | .008 | .021 |
| 6212 | .003 | 20.28 | 24.50 | 6.50 | .008 | .027 |
| 6213 | .008 | 20.30 | 24.50 | 6.48 | .007 | .008 |
| 6214** | .004 | 20.30 | 24.45 | 6.45 | .009 | .004 |
| 6215 | .006 | 20.32 | 24.47 | 6.48 | .001 | .024 |
| 6216 | .005 | 20.29 | 24.40 | 6.45 | .001 | .003 |
| 6246 | .002 | 20.54 | 24.28 | 6.48 | .018 | .020 |
| 6247 | .001 | 20.38 | 24.58 | 6.50 | .046 | .24 |
| 6248 | .001 | 20.48 | 24.58 | 6.50 | .012 | .15 |
| 6249 | .001 | 20.46 | 24.60 | 6.50 | .005 | .18 |
| 6250 | .0002 | 20.22 | 24.62 | 6.47 | .052 | .41 |
| 6251 (Simulated Air Melt) | .009 | 20.40 | 24.59 | 6.48 | .005 | .003 |
| 6297 | .006 | 20.30 | 24.42 | 6.53 | .010 | .055 |
| 6298 | .002 | 20.33 | 24.62 | 6.53 | .005 | .095 |
| 6299 | .002 | 20.39 | 24.50 | 6.58 | .045 | .080 |
| 6300 | .011 | 20.30 | 24.60 | 6.50 | .007 | .002 |
| 6301 | .002 | 20.41 | 24.52 | 6.48 | .011 | .060 |
| 6417 | .002 | 20.24 | 24.71 | 6.52 | .010 | .068 |
| 6418 | .002 | 20.28 | 24.60 | 6.50 | .009 | .085 |
| 6419 | .002 | 20.25 | 24.68 | 6.50 | .010 | .088 |
| 6420 | .004 | 20.43 | 23.53 | 6.52 | .005 | .078 |
| 6421 | .002 | 20.27 | 24.70 | 6.50 | .011 | .093 |
| 6422 | .003 | 20.34 | 24.74 | 6.53 | .009 | .043 |
| SE23 (Air Ind.) | .002 | 20.52 | 24.48 | 6.47 | .008 | .063 |

| Heat Rv- | Ca Aim | Ca Added | % Ca Recovery | Ce Added | % Ce Recovery | Ce Aim |
|---|---|---|---|---|---|---|
| 6211 | .03 | .06 | 13 | .065 | 32 | .04 |
| 6212 | .05 | .10 | 8 | .11 | 25 | .07 |
| 6213 | .01 | .02 | 35 | .016 | 50 | .01 |
| 6214** | .02 | .03 | 30 | — | | LAP |
| 6215 | .01 | .02 | 5 | .11 | 22 | .07 |
| 6216 | .05 | .10 | 1 | .016 | 19 | .01 |
| 6246 | .05 | .29 | 6 | .05 | 40 | .01 |
| 6247 | .05 | .29 | 16 | .35 | 69 | .07 |
| 6248 | .01 | .06 | 20 | .35 | 43 | .07 |
| 6249 | | 0 | — | .50 | 36 | .10 |
| 6250 | .05 | .29 | 18 | .50 | 82 | .10 |
| 6251 (Simulated Air Melt) | .01 | .06 | 8 | .05 | 6 | .01 |
| 6297 | .01 | .06 | 17 | .20 | 27 | .06 |
| 6298 | .01 | .06 | 8 | .25 | 38 | .09 |
| 6299 | .05 | .29 | 16 | .20 | 40 | .06 |
| 6300 | .05 | .14 | 5 | .04 | 5 | .01 |
| 6301 | .05 | .14 | 8 | .20 | 30 | .06 |
| 6417 | .01 | .06 | 17 | .14 | 49 | .04 |
| 6418 | .01 | .06 | 15 | .185 | 46 | .06 |
| 6419 | .01 | .06 | 17 | .215 | 41 | .08 |
| 6420 | LAP | 0.00 | — | .215 | 36 | .08 |
| 6421 | .01 | .06 | 18 | .25 | 37 | .10 |
| 6422 | .01 | .06 | 15 | .095 | 45 | .02 |
| SE23 (Air Ind.) | .01 | .06 | 13 | .185 | 34 | .06 |

LAP = low as possible.

*All heats had .018%-.055% C; 1.43%-1.73% Mn; .006%-.019% P; .023%-.11% Al; .016%-.070% $N_2$ and .0018%-.0114% $O_2$

**This heat had magnesium, columbium and titanium additions and recovered .002% Mg; .050% Cb and .040% Ti.

Minor element additions were made in the order of increasing reactivity; that is, aluminum, then calcium as nickel calcium, then cerium as Mischmetal (50% cerium). In Table I, Heats RV-6246 to RV-6251 used a pessimistic estimate of recovery of 20% cerium and approximately 17% calcium. Observed cerium recoveries generally ran in the range of 36% to 82%. FIG. 1 is a plot of percent cerium recovery versus percent cerium addition made using Heats RV-6211 to RV-6216 and RV-6246 to RV-6251 and later the additional heats were added and found to conform reasonably well. Cerium additions to recover the designed values were calculated and made to Heats RV-6297 through RV-6301. The calculated values conform substantially to the actual values as shown by the third group of melts in FIG. 1. Heats RV-6417 through RV-6422 and air melt Heat SE23 were made to add replications to the available data in the 0.02% to 0.08% cerium recovery range.

Figure 2:
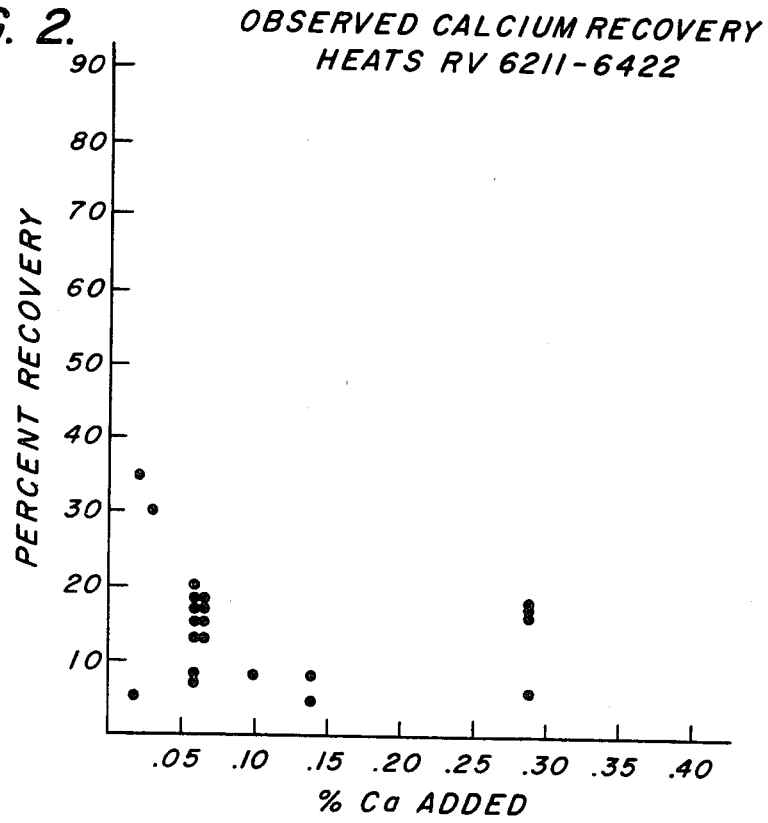
FIG. 2 is a plot of calcium recovery in the alloy of the invention versus calcium additions to the melt.

An inspection of Table I shows that cerium recovery varies to some extent with additions in the range of about 0.016% to 0.50% cerium in Mischmetal with generally higher recoveries occurring at higher additions, as illustrated in FIG. 1. Similar results for calcium recovery show a relatively constant 20% or less in the addition range of 0.02% to 0.29% calcium as nickel-calcium. This is shown in FIG. 2.

The cerium and calcium contents in the four groups of heats in FIG. 1 can be summarized as follows:

| Heat | Ce | Ca |
|---|---|---|
| RV-6211-6216 | .003% to .027% | .001% to .009% |
| RV-6246-6251 | .003% to .41% | .005% to .052% |
| RV-6297-6301 | .002% to .095% | .005% to .045% |

-continued

| Heat | Ce | Ca |
|---|---|---|
| RV-6417-SE23 | .043% to .093% | .005% to .011% |

As will be seen, most heats in the first group had poor workability, the cerium and calcium additions generally being too low. The same is true of the second group (RV-6246-6251) but for another reason — the cerium and calcium additions were generally too high. Best results were obtained with the heats in the last two groups, many of which have cerium and calcium contents falling within the critical limits of the invention.

In the initial series of heats shown in Table I (RV-6211 through RV-6216), a two-thirds recovery of cerium was anticipated in combination with a one-half recovery of calcium. However, actual cerium recovery ran low, in the range of 19% to 50% with normal recovery in the range of 22% to 32%. Actual calcium recovery ran in the range of 1% to 35% with the normal recovery less than 20%. This produced a series of heats shifted to lower than design cerium and calcium recoveries as can be seen from Table I. These heats were hot-rolled by a standard sequence shown in the following Table II, with finishing temperatures measured and controlled to around 2000° F for a ⅝ inch plate section, around 1800° F for one hot-rolled band and about 1500° F for another hot-rolled band.

TABLE II

| Hot Rolling Pass Sequence | |
|---|---|
| Start - 4" Square Ingot at 2250° F | |
| Roll 3.5" Mill Set, Rotate 90° & Roll 3.5" Square | (Reversing) |
| Roll 3.2" Mill Set, Rotate 90° & Roll 3.2" Square | (Reversing) |
| Cross Roll 3.0", 2.8", 2.6", 2.4", 2.2", 2.0" | (Reversing) |
| Roll 1.8", 1.6", 1.4", 1.2", 1.0", .8", .6" | (Reversing) |
| Note temperature after .6" pass - Crop 3 pieces | |
| Lay out 1 piece (app. 2000° F finish). | |
| Roll 1 piece Direct .5", .38", .3", .2", .1", 0" | (1 Direction) |
| Note temperature (app. 1500° F finish). | |
| Reheat 1 piece | |
| Roll .5", .38", .3", .2", .1", 0" Mill Sets | (1 Direction) |
| Note finish temperature (app. 1800° F finish). | |

Finish temperature and observed maximum edge tears, measured in 1/16 inch units, are listed in the following Table III:

TABLE III

Heaviest Edge Checking in 1/16" Units for Laboratory Heats Finished at Various Temperatures

| | Checking for End Product and Finish Temperature | | |
|---|---|---|---|
| Heat | Plate (app. 2000° F) | Strip (app. 1800° F) | Strip (app. 1500° F) |
| RV-6211 | 0 | 1 | 4 |
| -6212 | 0 | 0 | 4 |
| -6213 | 2 | 2 | 8 |
| -6214 | 0 | 1 | 4 |
| -6215 | 0 | 1 | 2 |
| -6216 | 0 | 0 | 6 |
| RV-6246 | 0 | 0 | 2 |
| -6247 | | Hot Short. Heat | |
| -6248 | 2 | 6 | 12 |
| -6249 | 2 | 3 | 12 |
| -6250 | | Hot Short. Heat | |
| -6251 | 0 | 2 | 1 |
| RV-6297 | 0 | 0 | 1 |
| -6298 | 0 | 0 | 3 |
| -6299 | 4 | 2 | 6 |
| RV-6300 | 4 | 2 | 4 |
| -6301 | 0 | 1 | 3 |
| RV-6417 | 0 | 1 | 4 |
| -6418 | 0 | 1 | 3 |
| -6419 | 0 | 1 | 3 |
| -6420 | 0 | 1 | 2-3 |
| -6421 | 0 | 1 | 3-4 |
| -6422 | 0 | 0 | 2 |
| SE-23 | 0 | 1 | 1-2 |

From Table III, it can be observed that Heat RV-6213 with relatively low cerium and calcium recovery and relatively high sulfur has the worst edge cracking characteristics.

In the next series of heats in Table I (RV-6246 to RV-6251), a relatively pessimistic estimate of 20% cerium recovery was estimated, in combination with a 17% recovery of calcium. Observed cerium recovery generally ran in the range of 36% to 82%; while observed calcium recovery generally ran around 17%. This produced a series of heats having higher than design cerium and calcium additions as can be seen from Table I. The exceptions are Heats RV-6246 and RV-6251 which were aimed at relatively low cerium recovery with RV-6246 also aimed at high calcium recovery. These heats were hot-rolled by a standard sequence shown in the foregoing Table II, except that Heats RV-6247 and RV-6250 containing the highest calcium recoveries cracked up in the initial phase and were laid out. These heats were considered "hot short" or at the point of incipient melting from the high cerium recovery.

Comparing the first two groups of Table I, generally low edge cracking is produced for 2000° and 1800° F finishing temperatures, except when cerium recovery is very high. At lower finishing temperatures, around 1500° F, checking is more severe and is seen on all strip samples. The severity is greatest for cerium recovery above 0.15% (RV-6248 and RV-6249). Checking is also objectionable at low recoveries and low finishing temperatures as shown by Heats RV-6213 and RV-6216 where the recovery was 0.008% and 0.003%, respectively.

From the first two groups of heats shown in Table I, it can be concluded that some minimum level of calcium plus cerium is required, but that an excessive recovery is more detrimental than a very low recovery. The third series of heats in Table I (i.e., RV-6297 through RV-6301) was designed to recover principally 0.06% cerium with an estimated cerium recovery of 33% from additions. Each were aimed at 0.01 or 0.05 calcium recovery at an estimated 17% recovery from additions. Table I shows that the cerium recovery in the third group of heats was generally close to design parameters while calcium recovery was again very low. The heat aimed at 0.05% calcium and 0.01% cerium (RV-6300) produced very low recoveries of both elements. The heat aimed at 0.06% cerium and 0.05% calcium produced 0.125% cerium plus calcium recovery (RV-6299); while the heat aimed at 0.06% cerium and 0.03% calcium (RV-6301) produced 0.071% cerium plus calcium. The total calcium plus cerium recovery ran from 0.009% to 0.125%. Heats RV-6297, RV-6298 and RV-6299 were considered to have achieved aim recoveries reasonably well.

The heats in the third group of Table I were again hot-rolled by the procedure shown in Table II. Of the group, Heat RV-6299 (High recovery — 0.125% cerium plus calcium) performed worst with edge cracking observed even as plate at 2000° F finishing temperature. This heat also edge cracked most severely of the group as cold finish strip. The next most severe edge cracking was observed in the low recovery Heat RV-6300 (0.009% cerium plus calcium). This heat also checked as plate and was second most severely checked as cold finish strip. Heats RV-6297, RV-6298 and RV-6301 were edge crack-free as plate and virtually crack free as hot finish strip. These same heats showed a low edge cracking as cold finish strip in comparison to Heats RV-6299 and RV-6300. It can be concluded from the third group of melts of Table I, therefore, that the cerium plus calcium level should be above 0.01% and less than 0.125%.

The fourth series of heats in Table I was designed to recover calcium at 0.01% plus or minus 0.005% and cerium in the range from 0.02% to 0.10%. An air induction heat SE23 was aimed at 0.01% calcium and 0.06% cerium. In the fourth group of Heats RV-6417 to RV-6422, cerium recovery ran very slightly higher than projected from FIG. 1. Calcium ran from 0.005% to 0.011% and cerium from 0.043% and 0.093%. These heats were rolled by the standard sequence shown in Table II. FIGS. 3–6 show the effect of cerium and cerium plus calcium additions on edge cracking. From Table III, it can be observed that for this group, no edge cracking was observed at finishing temperatures of 2000° F and only minor edge cracking at 1800° and 1500° F. The data gathered on the heats of Table I is summarized in FIGS. 3–6. In FIG. 3, it can be seen that edge cracking on hot finished strip is at a minimum in the range between about 0.020% and 0.080% cerium, the lowest edge cracking occurring at around 0.050%. FIG. 4 shows that edge cracking is at a minimum on hot-finished strip when the cerium plus calcium recovery is in the range of about 0.030% to 0.10% with the minimum edge cracking occurring at about 0.060% cerium plus calcium.

FIG. 5 summarizes the edge cracking characteristics of cold finish strip versus cerium recovery; and again the cerium recovery should be in the range of about 0.020% and 0.080%. FIG. 6 shows the results on cold finish strip versus cerium plus calcium recovery. As in FIG. 4, edge cracking on cold finish strip is at a minimum when the cerium plus calcium recovery is in the range of about 0.030% to 0.10%. From the foregoing, it can be concluded that calcium should be in the range of about 0.005% to 0.0015%. However, at least some of the desirable characteristics of the invention can be achieved as observed from FIGS. 3–6 when calcium is present in the range of about 0.005% to 0.050% and cerium is present in the range of about 0.020% to about 0.2%. It can also be observed from Table III that the finishing temperature should be around or above 1800° F and preferably about 2000° F.

As was mentioned above, a low sulfur content, on the order of 0.006% or less, is also important. This is illustrated in FIGS. 7 and 8 in which sulfur content is plotted against checks in 1/16 inch for all heats of Table I with a 0.10% maximum cerium plus calcium recovery. In FIG. 7, the finishing temperature is about 1800° F; whereas in FIG. 8, the finishing temperature is about 1500° F. In both cases, however, it can be seen that as sulfur content increases so does the number of edge checks, indicating poor hot-workability. At a finishing temperature of 1500° F, the effect is more pronounced, meaning that the lower the finishing temperature, the greater the importance of low sulfur contents.

It has been found that additions of cerium and calcium to the alloy of the invention do not degrade and actually enhance pitting resistance. In this regard, each of the heats of Table I was annealed at 2150° F for 10 minutes, then water-quenched, blasted and pickled and portions cold-rolled from 0.14 inch hot-rolled band to about 0.06 inch cold-rolled material. This material was then degreased and annealed for 5 minutes total time at 2000°, 2100°, 2150°, 2200° or 2250° F and water-quenched. At the 0.06 inch thickness, all heats showed extensive precipitation after the 2000° F anneal; however all heats were recrystallized and precipitate-free after the 2100° F anneal. No differences were observed with annealing temperatures in excess of 2100° F except for a coarsening of grain size. Once the precipitate formed after air cooling from hot rolling has been solutioned at 2150°, a 2100° F anneal is satisfactory for maintaining a precipitate-free structure in process. Since pitting resistance is somewhat affected by final annealing temperature, the 0.065 inch samples taken for ferric chloride testing were annealed at the higher 2150° F – 5 minutes furnace time and water-quenched. Sample stock was blasted, pickled and skin passed to 0.060 inch, sheared ⅛ inch oversize in each direction and planed to 2 × 1 inch samples. Before testing, the samples were degreased, repickled and weighed to 0.0001 gram. The test of pitting resistance scheduled was a 10% ferric chloride rubber band test with very pitting resistant material defined by zero weight loss in a 72-hour test at room temperature. Samples initially weighed about 16 grams as 2 × 1 × 0.062 inch. Consequently, weight loss to perhaps 0.0016 grams is virtually nil, representing a loss of one part in 10,000. This can be compared, for example, with conventional tube alloy losses of 0.4 to 0.6 gram for Type 304 stainless steel and 0.2 to 0.3 loss for Type 316 stainless steel. Tests at 95° F were also conducted which had the effect of making the pitting solution more aggressive.

The test results are shown in Table IV for tests of three samples per condition:

TABLE IV

Weight Loss of Approximately 16 Gram Samples of .062" Strip Annealed at 2150° F and Tested in the 10% Ferric Chloride Rubber Band Test at Room Temperature and 95° F

| Heat | Room Temp. Losses (Grams) | | | 95° F Losses (Grams) | | |
|---|---|---|---|---|---|---|
| RV-6211 | .0004 | .0003 | .0000 | .0392 | .0386 | .0401 |
| RV-6212 | .0002 | .0001 | .0001 | .0004 | .0001 | .0003 |
| RV-6213 | .0000 | .0002 | .0001 | .0002 | .0127 | .0097 |
| RV-6214 | .0000 | .0003 | .0001 | .0001 | .0003 | .0002 |
| RV-6215 | .0003 | .0005 | .0003 | .0004 | .0176 | .0009 |
| RV-6216 | .0002 | .0002 | .0000 | .0003 | .0001 | .0015 |
| RV-6246 | .0000 | .0000 | .0000 | .0083 | .0274 | .0043 |
| RV-6248 | .0001 | .0006 | .0000 | .1248 | .0175 | .0198 |
| RV-6249 | .0000 | .0002 | .0001 | .1285 | .1799 | .0095 |
| RV-6251 | .0000 | .0000 | .0001 | .0022 | .0024 | .0101 |
| RV-6297 | .0002 | .0003 | .0003 | .0011 | .0021 | .0026 |
| RV-6298 | .0005 | .0005 | .0003 | .0008 | .0031 | .0079 |
| RV-6299 | .0003 | .0002 | .0002 | .0000 | .0000 | .5896 |
| RV-6300 | .0000 | .0000 | .0000 | .2351 | .0098 | .2770 |
| RV-6301 | .0003 | .0001 | .0014 | .2082 | .0299 | .0036 |
| RV-6417 | .0017 | .0002 | .0008 | .0556 | .4689 | .6508 |
| RV-6418 | .0002 | .0000 | .0002 | .0048 | .5124 | .0209 |
| RV-6419 | .0006 | .0004 | .0090 | .7618 | .1692 | .4450 |
| RV-6420 | .0011 | .0016 | .0003 | .2247 | .1930 | .3630 |
| RV-6421 | .0033 | .0002 | .0026 | .4072 | .3981 | .3769 |
| RV-6422 | .0026 | .0009 | .0002 | .4142 | .2378 | .1541 |
| SE-23 | .0006 | .0006 | .0025 | .2639 | .1169 | .0080 |
| Typical 304 | | .4–.6 | | | 1–1.2 | |
| Typical 316 | | .2–.3 | | | .8–1.0 | |

Losses of 0.0003 gram or less are not significant as this is generally the limit of repeatability of the balance. No heat was grossly attacked at room temperature tests. Furthermore, no heat was attacked beyond the virtually nil one part in 10,000 on all room temperature samples. Most room temperature samples, as illustrated in Table IV, showed no attack when observed at 20 diameter magnification. This represents excellent pitting resistant material.

The invention thus provides a new and improved austenitic stainless steel alloy which has both excellent pitting resistance as well as good hot-workability by virtue of the addition of certain critical amounts of both cerium and calcium while at the same time maintaining residual sulfur low.

Although the invention has been shown in connection with certain specific examples, it will be readily apparent to those skilled in the art that various changes can be made to suit requirements without departing from the spirit and scope of the invention.

I claim as my invention:

1. A method for producing an austenitic stainless steel alloy consisting essentially of about 20% to 40% nickel, 14% to 21% chromium, about 6% to 12% molybdenum, 0.010% to 0.20% cerium, 0.005% to 0.050% calcium and the remainder substantially all iron, which comprises melting said alloy and casting it into a shape which can be rolled, and thereafter hot rolling said shape with a finishing temperature after rolling about or greater than 1800° F.

2. The method of claim 1 wherein said finishing temperature is 2000° F.

3. The method of claim 1 wherein the steel has up to 0.2% carbon, up to 2% manganese and up to about 0.006% sulfur.

4. The method of claim 1 wherein the steel has a calcium plus cerium content of 0.03% to 0.10%.

* * * * *